US006968910B2

(12) United States Patent
Bar-Cohen et al.

(10) Patent No.: US 6,968,910 B2
(45) Date of Patent: Nov. 29, 2005

(54) ULTRASONIC/SONIC MECHANISM OF DEEP DRILLING (USMOD)

(76) Inventors: Yoseph Bar-Cohen, 3721 Fuchsia St., Seal Beach, CA (US) 90740; Stewart Sherrit, 5849 Buena Vista Ter., Los Angeles, CA (US) 90042; Benjamin Dolgin, 9249 Reseda Blvd., Suite 104, Northridge, CA (US) 91324; Xiaoqi Bao, 8839 Emperor Ave., San Gabriel, CA (US) 91775; Stephen Askins, 103 Mathewson Mill Rd., Ledyard, CT (US) 06339

( * ) Notice: Subject to any disclaimer, the term of this patent is extended or adjusted under 35 U.S.C. 154(b) by 146 days.

(21) Appl. No.: 10/304,192

(22) Filed: Nov. 27, 2002

(65) Prior Publication Data

US 2003/0116355 A1 Jun. 26, 2003

Related U.S. Application Data

(60) Provisional application No. 60/341,443, filed on Dec. 20, 2001.

(51) Int. Cl.[7] ..... E21B 7/24; E21B 49/02
(52) U.S. Cl. ..... 175/56; 175/249
(58) Field of Search ..... 175/56, 249, 405, 175/404

(56) References Cited

U.S. PATENT DOCUMENTS

| | | | | |
|---|---|---|---|---|
| 1,656,526 | A * | 1/1928 | Lincoln | 175/308 |
| 2,903,242 | A * | 9/1959 | Bodine, Jr. | 175/55 |
| 5,411,106 | A * | 5/1995 | Maissa et al. | 175/78 |
| 6,550,549 | B2 * | 4/2003 | Myrick | 175/58 |
| 6,729,416 | B2 * | 5/2004 | Contreras et al. | 175/20 |
| 2004/0007387 | A1 * | 1/2004 | Bar-Cohen et al. | 175/50 |

OTHER PUBLICATIONS

Proceedings of the EAPAD Conf., SPIE's 8th Annual International Symp. on Smart, Newport Beach, CA, Mar. 5-8, 2001, #4327-55, (USDC) For Planetary Applications, Y. Bar-Cohen, et al.

S. Sherrit, et al, "Novel horn designs for ultrasonic/sonic cleaning, welding, . . . ," Proceedings of the 9th SPIE, Smart Struct. & Integrated Sys. Conference, paper 4701-34, (2002).

* cited by examiner

*Primary Examiner*—William Neuder

(57) ABSTRACT

The present invention provides an ultrasonic and sonic mechanism of deep drilling (USMOD) that is driven by a vibrating actuator and operates in a similar manner to the gopher with regards to drilling debris removal. The actuator induces vibration in the form of a hammering actuation. The mechanism consists of a penetration bit with a diameter that is the same or larger than the actuator. The embodiment of the invention that is disclosed herein emulates a gopher. This ultrasonic gopher is lowered down into the produced borehole, cores the medium, breaks and holds the core, and finally extracts and deploys the core.

A USMOD device consists of power drive and a drill-head. The power driver generates ultrasonic pulses to activate the USMOD mechanism and it allows optimized use of power by duty cycling the signal. The drill-head consists of an actuator, free mass and a penetration bit. The actuator consists of a vibration source and a horn that amplifies the amplitude of the vibration. The horn has a cylindrical cross-section to produce a drill-head that has cylindrical configuration and eliminate undesirable trapping of extracted soil and powdered cuttings. A cavity inside the tubular-shape horn provides space for packaging miniature instrumentation and sensors. The actuator activates an integrated free-mass that hammers the penetration bit, where the free-mass operates as a transformer to lower the vibration frequency to produce the hammering action. In one implementation of the USMOD it is designed to contain a trap for collection of upward traveling dust, debris and powdered cuttings.

1 Claim, 2 Drawing Sheets

ULTRASONIC/SONIC MECHANISM OF DEEP DRILLING (USMOD)

ORIGIN OF THE INVENTION

This application claims the benefit of U.S. Provisional Patent Application No. 60/341,443 filed on Dec. 20, 2001 and entitled "Ultrasonic/Sonic Mechanism Of Deep Drilling (USMOD)."

BACKGROUND OF THE INVENTION

1. Field of the Invention

The present invention relates to a mechanism that is equipped to penetrate deep into the ground beyond the length of the mechanism. The present invention is a device that is actuated by inducing vibrations in the ultrasonic frequency range to impact a penetration bit in the sonic frequency range. The invention performs penetration of various media that include rocks, ice and soil. In the embodiment of the invention the medium is cored and the cored material is removed from the borehole, and emptied outside the borehole and the process is repeated till the desired depth is reached.

2. Background of the Invention

There are many areas that require effective drilling and coring operation to make boreholes and extract material from a medium. Some of the areas for which such applications are used include planetary exploration, military, construction, police investigations, geology, archeology, search and rescue and games. Deep drilling is conducted by cumbersome and heavy mechanisms that consume large amounts of power limiting the possibilities that can be considered.

The capability of existing rotary coring mechanisms is limited by power and mass requirements and is constrained by the operation environment. Typically, a rotary corer that produces 10 mm cores in hard rocks requires at least 20–30 watts of power. The drilling rigs cannot be duty cycled without a staggering loss of efficiency. On start-up the drilling motors can demand as much as 3–4 times larger electrical currents than those during continuous operations. In contrast, the drive mechanism that is responsible for the operation of this invention uses less than 20% of the current that is used by conventional methods. These corers require over 100-N of axial preload, where 150-N being a typical number. During core initiation, the drill walk can induce torques on the drilling platform that may exceed 30-N·m and tangential forces in excess of 100-N. Drill chatter delivers low frequency (2–10 Hz), high force perturbations on the drilling platform limiting conventional corer applications to very stable and massive platforms. In hard rocks, conventional drillers and corers lose the advantage that they sometimes demonstrate in soft materials. In hard rocks, conventional corers stop drilling by shearing and spoliation and become grinders. The latter process is accompanied by at least a 300% increase in consumed energy per unit length of the core. In addition, because the grinding mechanism is determined by the compression failure of the rock, the sharp teeth of the corers must be re-sharpened frequently. The sharpness of bits has to be monitored because otherwise the heat generation at the tip may increase by a factor of 10. This increase is accompanies with a similar drop in drilling efficiency and often it is causing burning or melting of the drill bit.

Non-traditional drilling technologies that include laser, electron beam, microwave, jet, and others are usually competitive only in applications that are not power limited.

Typically, down-the-well energy required to remove a unit volume of rock for "modern" technologies are the same as grinding and melting, that is 3 and 5 times higher, correspondingly, than that for shear drilling. Unfortunately, the ratio of down-the-well power delivered vs. input power generation is below several percent vs. 10%–30% for conventional drills. Thus, many applications do not have enough power to employ non-traditional drilling technologies.

It is the object of this invention to provide drilling mechanism that penetrates deep into various media reaching beyond its penetrator length. In addition, it is the object of this invention to provide a device that is lightweight, compact and consumes low amounts of power. Further, it is the object of this invention to provide deep penetration mechanisms that can operate at low and high temperatures and plurality of pressure levels.

SUMMARY OF THE INVENTION

This invention involves a novel mechanism that has a shape of a capsule that penetrates media beyond the length of the penetrator. The invention performs ground penetration, deep coring, and sampling. The invention consists of a power driver and a drill-head. This invention is driven by an actuator that produces high frequency vibrations to induce hammering action thought a free-mass onto a penetration bit. The invention is a compact system and it requires relatively low axial-preload. The actuator vibrates a horn that has a tubular shape and it impacts a free-mass that is integrated into the penetration bit. The cavity inside the horn that also has a tubular shape provides space for packaging instrumentation and feedback sensors. The free-mass operates as frequency transformer to produce low frequency hammering action. A penetration bit is used with an outside diameter of about the same or larger size than the actuator section. Tangential forces that are generated by the drill-head can be used to rotate or steer the drill-head to minimize drill jamming, premature core fractures and to navigate the device inside the penetrated medium.

The present invention provides a deep coring mechanism that uses low axial load, does not require torque forces, and self-removes the produced powdered cuttings up the borehole. The penetration bit does not require sharpening, and no rotation is needed to penetrate the impacted medium. Unlike conventional drills, the drill-head does not have any gears or motors, and does not require lubricants. Use of a piezoelectric stack as a mechanical driver permits the device to operate over a very wide temperature range.

The disclosed invention involve a biologically-inspired operation embodiment that emulates a gopher's cyclic operation of digging tunnels in the ground, namely coring, uploading to the surface, extracting the cored material and downloading the drill-head into the borehole for continued operation. The horn and the penetration bit are designed to contain a trap for collection of upward traveling dust, powdered cuttings and debris. The device can be uploaded via cable from the ground surface or can be made with drive mobility components that mobilize the USMOD device in and out of the borehole using an inchworm mechanism. A human operator, a rover and simple surface-base platform are plurality of deployment modalities for the execution of penetration procedures using the disclosed invention. A corrugated bellow with a spring mechanism can be used as a support feature to form an erectable barrier to prevent the borehole wall from collapsing when drilling unconsolidated materials such as sand and soil.

BRIEF DESCRIPTION OF THE DRAWINGS

The invention will be more understood from the following detailed description of representative embodiments thereof read in conjunction with the accompanying drawings wherein.

DETAILED DESCRIPTION OF THE PREFERRED EMBODIMENT

Figure 1:
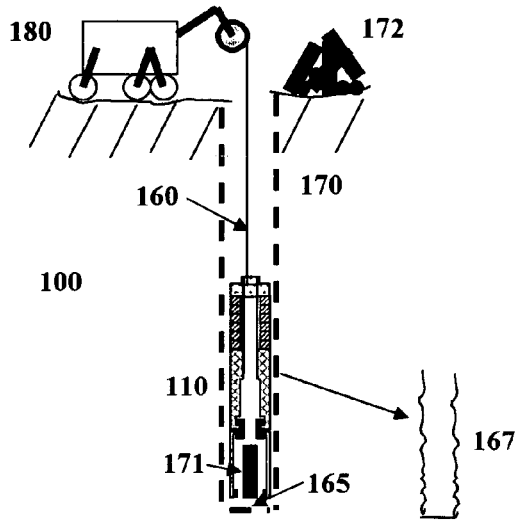
FIG. 1 is one embodiment perspective view of this USMOD invention as a deep drilling device in an ultrasonic-gopher embodiment
Figure 2:
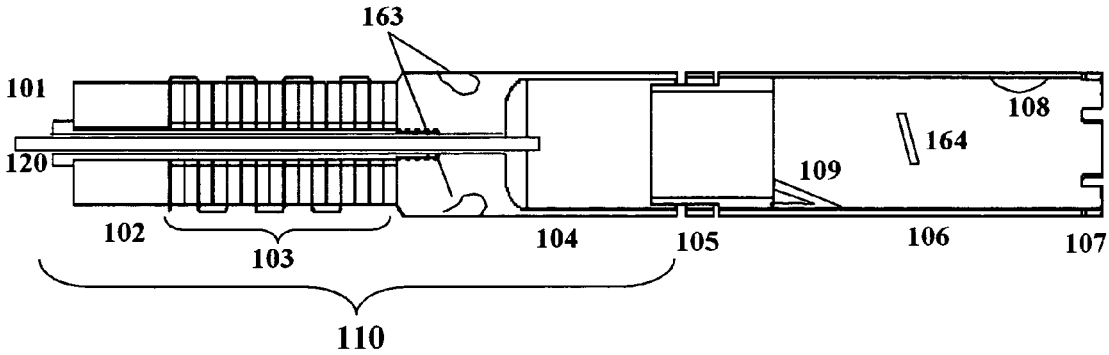
FIG. 2 is a cross-section view of the Ultrasonic-Gopher embodiment of the USMOD system according to the present invention.
Figure 3:
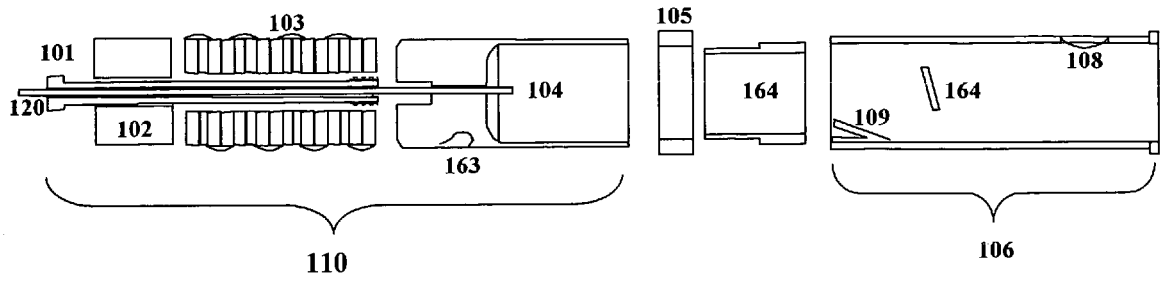
FIG. 3 is a cross-section view of the components of the Ultrasonic-Gopher embodiment according to the present invention.
Figure 4:
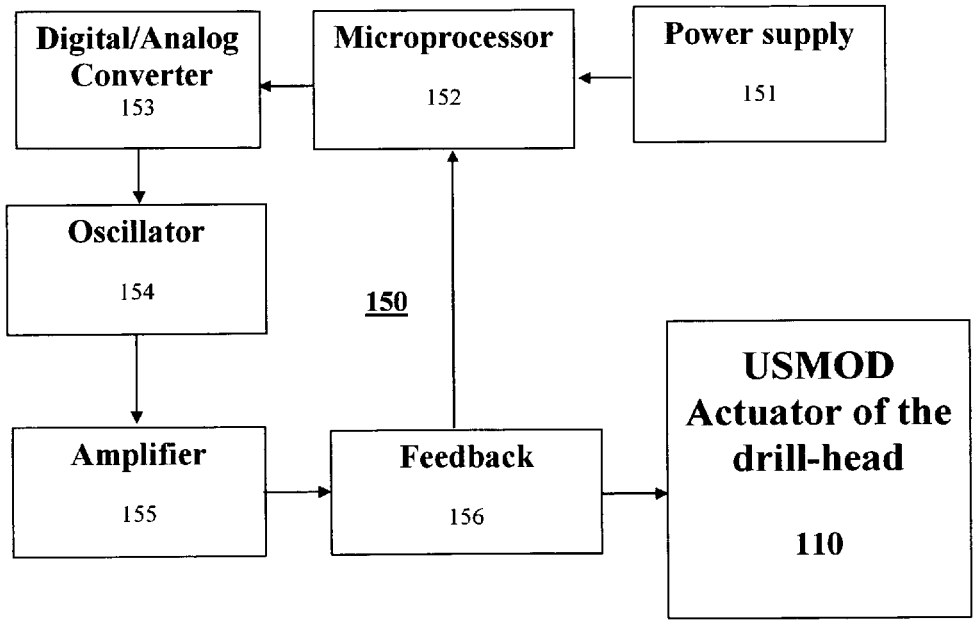
FIG. 4 is a block diagram of the invention power drive components.

In the following description of the preferred embodiment, reference is made to the accompanying drawings, which form a part thereof, and in which by way of illustration, a specific embodiment in which the invention may be practiced. It is to be understood that other embodiments may be utilized and structural changes may be made without departing from the scope of the present invention. FIG. 1 is a perspective view of the USMOD system in the present invention. FIG. 2 is showing cross-section view of the present invention. FIG. 3 is a view of the components of the USMOD embodiment and FIG. 4 is a view of the power driver block diagram. The invention described herein uses an actuation mechanism that was demonstrated to drill rocks as hard as basalt using low power, as low as 5-Watts, and nearly zero axial-force. This mechanism does not require lubricants and it performs self-removal of its powdered cuttings.

Turning now to FIG. 1, embodiments 100 of the present USMOD invention. This embodiment consists of a power driver and a drill-head 110 and they are connected electrically. The drill-head 110 consists of a transducer 103 with a tubular shape horn, integrated free-mass and a penetration bit that has a diameter that is equal or larger than the actuator. A cross-section view of this Ultrasonic-Gopher embodiment of the USMOD mechanism 100 is shown in FIG. 2. The components of the Ultrasonic-Gopher embodiment are shown in FIG. 3. The elements that are used to break the core 109 and hold it 108 for removal from the borehole are also shown. The block diagram of the power drive system 150 is shown in FIG. 4 and it consists of power supply 151, microprocessor 152, digital/analog converter 153, oscillator 154, amplifier 155, feedback 156 and the USMOD Actuator in the drill-head 110.

This invention uses a combination of ultrasonic and sonic vibrations that are induced by a transducer that consists of a plurality of possible mechanisms that include piezoelectric and electrostrictive stacks 103 that are clamped via bolt 101 by the backing ring 102 and the horn 104 as well as a free-mass 105. This combination of actuation mechanism 110 and free-mass 105 forms an effective drilling vibration source that requires relatively low axial-force to perform drilling. It can be made to work at very low temperatures down to single digit Kelvin degrees (down to about −270° C.) to very high exceeding 800 degrees Kelvin (500° C.). The horn 104 amplifies the ultrasonic vibrations that are induced by the transducer 103 and impacts the free-mass 105 making it to oscillate between the horn 104 and the penetration bit 106. The free-mass 105 allows the penetration bit 106 to operate under a combination of the high frequency (5 kHz and up) and a 60–1000 Hz sonic hammering. It is currently capable of high-speed drilling (reaching speed of 2 mm per Watt-hour in basalt and 20 mm per Watt-hour in Bishop Tuff, when drilling a 6 mm diameter borehole) using low axial preload that is less than 10N and low power that can be as little as 2 watts average. The horn 104 is shaped in an inverse configuration of a tube allowing the formation of a tubular shape drill-head that can core media and continue to propagate by extracting and dumping the core that is formed inside the penetration bit 106 each time its cavity is filled all the way to its back end. The free-mass 105 and its coupled operation with the actuator 110 are responsible for the high drilling efficiency.

The cavity inside the horn 104 provides space for packaging instrumentation and sensors. A penetration bit 106 with a diameter that is equal or greater than the actuator section 110 is used, and a thick piezoceramic stack transducer 103 is used to provide the necessary impact forces. The drive actuator 110 consists of a large piezoelectric stack that is held in compression by a bolt 101. To enhance the drilling efficiency teeth 107 are cut into the end of the penetration bit 106. In order to break the produced core a wedge 109 is incorporated into the back end of the penetrator cavity. When the produced core 171 reaches the wedge 109 transverse forces are applied onto the core 171 causing it to fracture at its root 165. To keep the core from falling out when the drill-head 100 is lifted from the borehole, a retaining spring 108 is installed onto the penetrator inside surface and it is slightly raised with the surface of the bit by making a groove onto the surface of the bit. Rotating the penetration bit allows prevention of jamming, making more uniform hole and improve the drilling efficiency. A helical notch 164 on the penetration bit 106 induces rotation of the penetration bit from the vibrations. When the bit is engaged with a rock, the impacts of the free-mass 105 induces rotation of the bit where the direction is dictated by the direction of the slot 164.

The actuator of the USMOD system 110 is made of a metal-piezoceramic-metal sandwich 103 that is clamped by a bolt 101 to keep the piezoceramic stack 103 in compression and to dissipate the induced heat. This bolt 101 is an important element in the construction of the transducer 103, which is used to mount the transducer assembly 103 and maintain the strength of the piezoelectric stack 103 that is made of a ceramic material. When the piezoelectric stack vibrates under high drive voltages, the tensile stress reaches levels that can fracture the ceramic material of the stack. The stress bolt 101 is tightened to assure the induction of compression forces at a level that slightly exceeds the expected maximum level of tensile stress.

In this disclosed embodiment a piezoelectric transducer 103 operates as the source of high frequency vibration but other type of transducers can also be used including voice coil, and ferroelectric and electrostrictive stacks. The ultrasonic actuator assembly 110 operates as a half-wave transformer with a backing material 102 and actuator 103 acting as a quarter wave resonator. Under this condition, the transducer 103 radiates most of its output energy forward into free mass 105 and penetration bit 106 that operates as the load of the transducer 103. The frequency at which the whole assembly resonates depends mostly on the density and sound velocity of the various sections of the actuator 110 and the thickness of each of its sections.

A corrugated bellow with a spring mechanism 167 can be used as a support feature to form an erectable barrier to prevent the borehole wall from collapsing when drilling unconsolidated materials such as sand and soil.

The embodiment of the Ultrasonic-Gopher 100 is shown in FIG. 1 and its cross section view in FIG. 2 and detailed view of the components of the drill-head 110 in FIG. 3. The drill-head 110 can be operated by a battery power 151 and delivered by a suspension cable 160 to the bottom of the borehole 165 for continued operation after the dumping of the cored material 171 from the penetration bit 106 at the deployment or accumulation area 172. A bolt 101, as shown in FIG. 2, in the actuator section 110, braces the transducer stack 103. The horn with a tubular shape 104 is shown next to the transducer stack 103 has a tubular shape. The bobbin-shape of the integrated free-mass 105 is placed next to the horn 104 and is mounted on the penetration bit 106 and supported by a fixture 164 that is placed between the free-mass 105 and the penetration bit 106. The penetration bit 106 has a tip 107 that is made of a hard material, such as tungsten carbide, and as illustrated in the bottom of FIG. 2 the end of the bit has a teeth shape 107 to enhance the penetration by breaking the cored medium 170 at the bottom of the borehole 165.

Experiments have shown that the dust, powdered cuttings and debris that are produced by the drill-head 100 travel upward along the side of the penetration bit surface 106. In the design of the penetration bit a trap 163 is included to collect the debris for uploading to the surface. This trap that consists of a groove can be imbedded into the penetration bit or the horn. Once a core 171 it is broken by the internal wedge 109 of the penetration bit 106, it is retained by the retaining spring 108. The drill-head 100 suspension-cable 160 is used to lift the drill-head with the core 171, which is dumped into the pill of removed cores 172 above the ground 170. The low power and axial load operation capability of the drill-head 100 allows operating from light mobility platforms 180 overcoming the power and bracing limitations of alternative mechanisms.

If the Ultrasonic-Gopher needs to have a hollow center through its actuator 110, the stress bolt 101 can be designed as a threaded tube that is placed through the center of the piezoelectric stack 103.

What is claimed is:

1. Apparatus that penetrates media to depths beyond the length of the apparatus, comprising of a. high frequency vibration actuator that induces low frequency impact hammering action that enables penetration of media b. penetration bit comprising of a tube with a cylindrical cross section having diameter that is equal or larger than the actuator that hammers the bit into the medium c. penetration bit further comprising a trap for collection of the removed dust, powdered cuttings and debris d. penetration bit further comprising an internal wedge for breaking cores upon reaching pre-selected length e. penetration bit further comprising a retaining spring that holds the produced core f. penetration bit further comprising a push rod for the removal of the produced core from the penetration bit g. penetration bit further comprising a helical notch that induces rotation of the bit using the induced vibration with no motor drive.

* * * * *